United States Patent [19]

Fukutsuka et al.

[11] 4,369,073

[45] Jan. 18, 1983

[54] METHOD FOR PROTECTING THE INNER SURFACE OF A COPPER ALLOY CONDENSER TUBE FROM CORROSION

[75] Inventors: Toshio Fukutsuka; Kazutoshi Shimogori, both of Kobe; Etsuo Yamamoto, Osaka; Kenji Miki, Himeji, all of Japan

[73] Assignee: Kabushiki Kaisha Kobe Seiko Sho, Kobe, Japan

[21] Appl. No.: 256,121

[22] Filed: Apr. 21, 1981

[30] Foreign Application Priority Data

| | | | |
|---|---|---|---|
| Apr. 25, 1980 | [JP] | Japan | 55-55873 |
| Feb. 13, 1981 | [JP] | Japan | 56-20334 |
| Feb. 13, 1981 | [JP] | Japan | 56-20335 |
| Feb. 13, 1981 | [JP] | Japan | 56-20336 |

[51] Int. Cl.[3] ..... B05D 3/04; B05D 1/02; B05D 7/22; B05D 3/12

[52] U.S. Cl. ..... 148/6.14 R; 148/6.31; 148/6.35

[58] Field of Search ..... 427/237; 148/6.14 R, 148/6.31, 6.35

[56] References Cited

FOREIGN PATENT DOCUMENTS 52-71697 2/1977 Japan .

*Primary Examiner*—James R. Hoffman
*Attorney, Agent, or Firm*—Oblon, Fisher, Spivak, McClelland & Maier

[57] ABSTRACT

A thin corrosion protective film of an iron oxide can be formed on the inner surface of a condenser tube made of a copper alloy by first applying on the inner surface a thin layer of an acidic suspension containing iron powder and then exposing the thus-coated inner surface to an atmosphere of an oxidizing gas. The above method can be carried out in a relatively short period of time and also in a relatively simple fashion. The resultant protective film is uniform and hardly reduces the thermal conductivity of the condenser tube, thus ideal as a protective film for condenser tubes of a heat exchanger.

17 Claims, 6 Drawing Figures

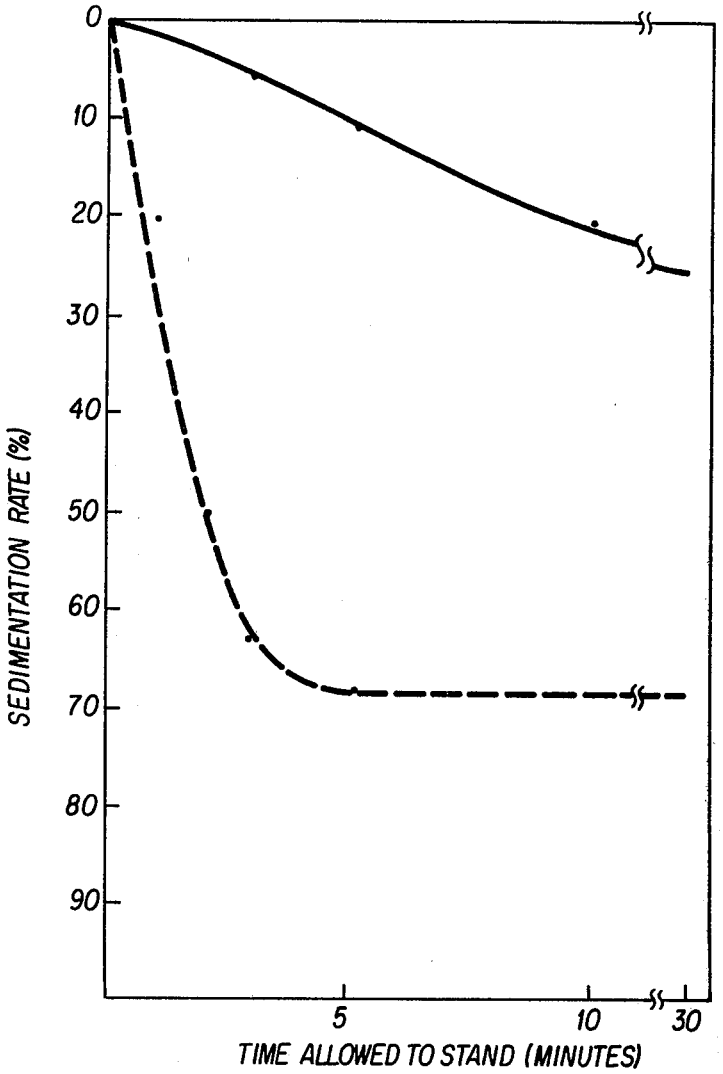
FIG. 3-(a)

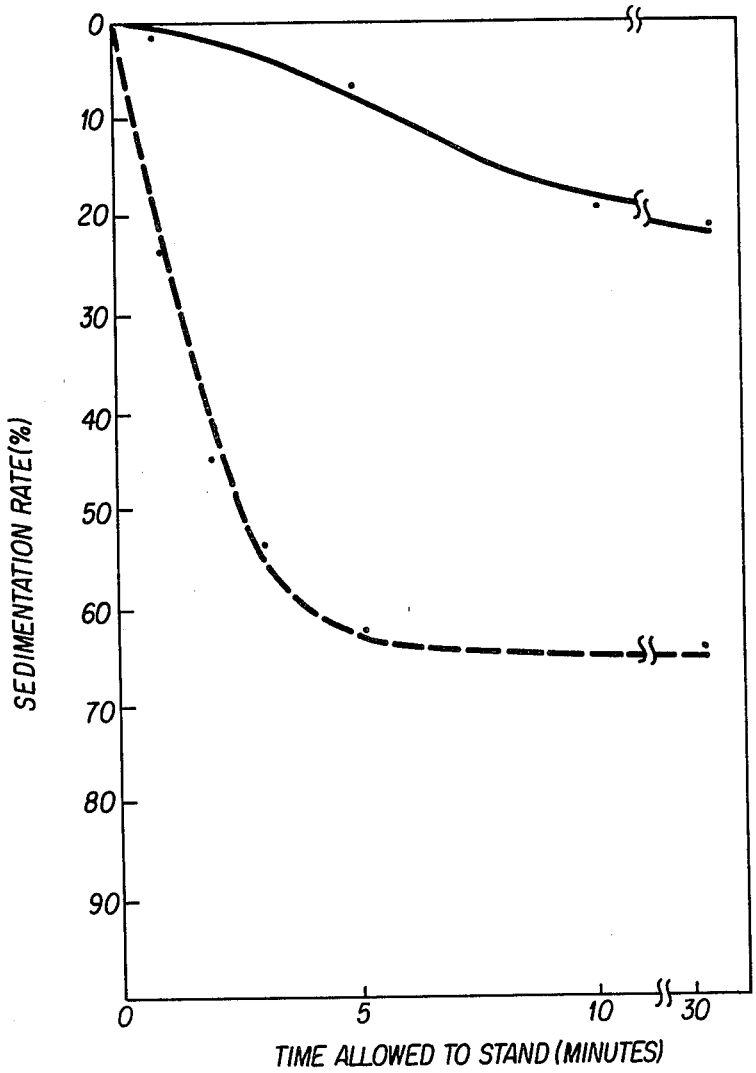
FIG. 3-(b)

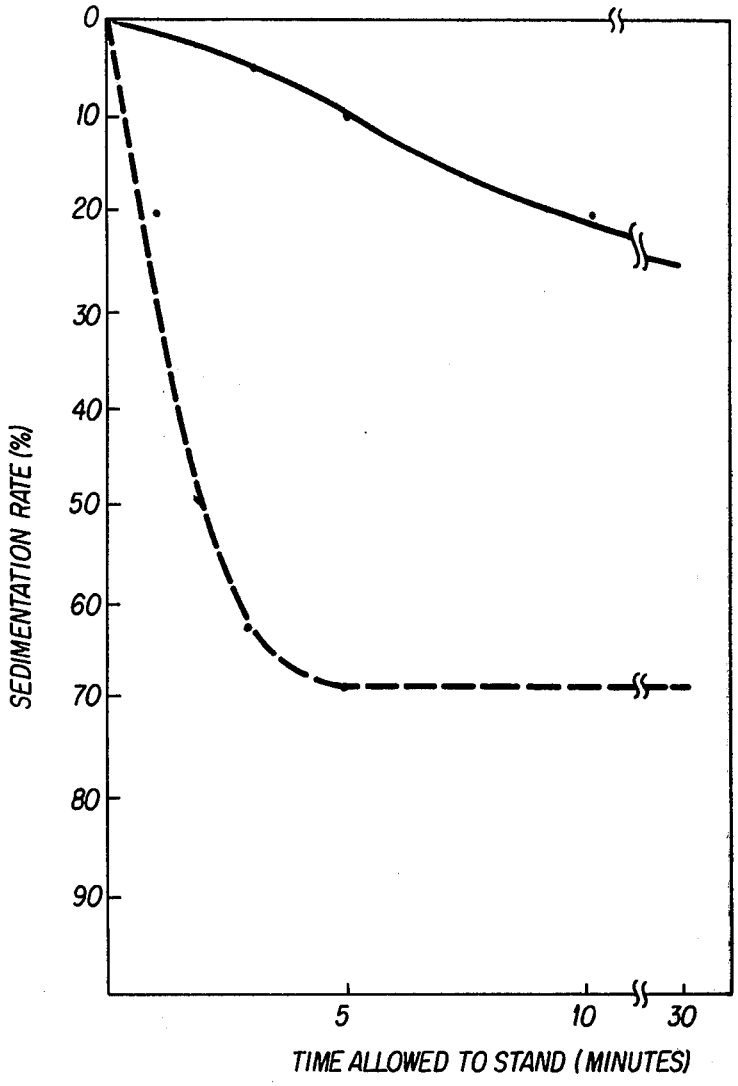
FIG. 3-(c)

METHOD FOR PROTECTING THE INNER SURFACE OF A COPPER ALLOY CONDENSER TUBE FROM CORROSION

BACKGROUND OF THE INVENTION

1. Field of the Invention

This invention relates to a method for protecting a metallic surface from corrosion, more particularly, to a method for forming on the inner surface of a copper alloy condenser tube a film of an iron oxide, which film serves to protect the inner surface from corrosion.

2. Description of the Prior Art

A film of an iron oxide such as ferric oxyhydroxide (FeOOH) pertains excellent properties as a corrosion protective film for the inner surface of a copper alloy condenser tube adapted for use in a heat exchanger. In a representative method for forming such a film, ferrous ions are incorporated in sea water as a coolant and the thus-prepared ferrous ion-containing sea water is fed into a condenser tube to form a chemically produced protective film on the inner surface thereof. However, this method is accompanied by a drawback that the film-forming speed is extremely slow, coupled by a problem from the viewpoint of environmental protection that water containing iron ions are discharged. Another method is disclosed in Laid-open Japanese Patent Specification No. 71697/1977 laid open to the public on June 15, 1977; naming as the applicant Nippon Electric Co., Ltd., and as the inventors Shigeo Noguchi, Kozo Nishimoto, and Morimasa Nagao; and entitled "PREPARATION METHOD OF THIN MAGNETIC FILM OF IRON OXIDE", in which, after immersing a substrate in an aqueous acidic solution, the solution is heated to 50°–80° C. while blowing an oxidizing gas thereinto, and iron powder is then thrown into the solution. However, this method is not practical as no protective film would be formed at all on a copper alloy substrate or the film-forming speed is extremely slow.

In view of the above-described drawbacks of the conventional methods, the present inventors have proceeded with various researches with a view toward developing a method capable of forming efficiently a corrosion-protective film of an iron oxide on the inner surface of a copper alloy condenser tube in a simple operation. As a result, it has been found unexpectedly that the above object would be achieved fully by adopting a new method which will be described below, resulting in the completion of this invention.

The principal feature of a method for protecting an inner surface from corrosion in accordance with this invention resides in applying a thin layer of an acidic suspension containing iron powder onto the inner surface of a copper alloy condenser tube and exposing said thin layer to an atmosphere of an oxidizing gas to form a film of an iron oxide on said inner surface.

The present invention is similar to the method disclosed in the above-referred Laid-open Japanese Patent Specification No. 71697/1977 in that both inventions use an acidic solution or suspension containing iron powder and an oxidizing gas. However, in the present invention, the inner surface of a condenser tube is exposed to an atmosphere of an oxidizing gas while being applied with a thin layer of the acidic suspension containing iron powder and the formation of a protective film can be performed at an extremely high speed. Such a fast formation of the protective film may be attributed to the following reasons. Namely, iron particles contained in the suspension have many chances to be brought into contact with the copper alloy base. As shown in FIG. 1, an iron particle 1 and the copper alloy base 2 act as an anode and cathode respectively, and a colloidal particle 3 of resultant iron oxyhydroxide or the like (charged positive under mild acidic conditions) is electrostatically attracted onto the surface of the copper alloy base 2, thereby achieving an extremely fast formation of a film of iron oxyhydroxide or the like and also enhancing the adhesion of the thus-formed film to the base. The numerals 3 and 4 are respectively a thin layer of an acidic suspension and an oxidizing gas atmosphere.

SUMMARY OF THE INVENTION

With the foregoing in view, an object of this invention is to provide a method for forming in a short period of time a corrosion-protective film on the inner surface of a copper alloy condenser tube with an acidic suspension in the amount of least necessity.

According to one aspect of this invention, there is provided a method for forming a film of an iron oxide on the inner surface of a copper alloy condenser tube by applying a thin layer of an acidic suspension containing iron powder on the inner surface and then exposing the thin layer to an atmosphere of an oxidizing gas.

The above objects, features and advantages of the present invention will become more apparent from the following description and appended claims, taken in conjunction with the accompanying drawings which show by way of example preferred embodiments of the present invention.

BRIEF DESCRIPTION OF THE DRAWINGS

In the accompanying drawings:

FIGS. 3(*a*) to 3(*c*) are each a diagrammatic illustration showing relationship between preparatory oxidation and sedimentation rate.

DETAILED DESCRIPTION OF THE PREFERRED EMBODIMENT

Figure 1:
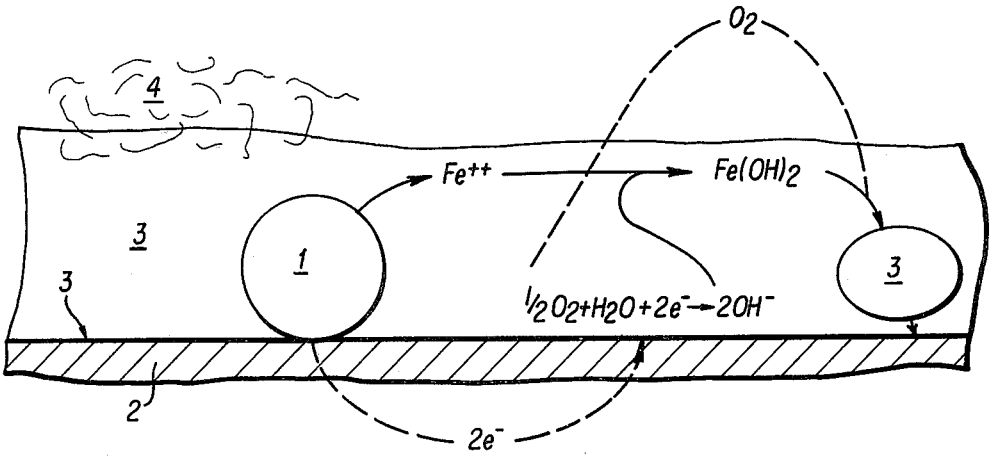
FIG. 1 is a schematic illustration showing the principle of a corrosion-protective method according to this invention.

The thickness of an acidic suspension containing iron powder to be applied onto the inner surface of a condenser tube is considered to have a considerable effect on the film-forming speed. As a result of a verification experiment, it was determined that the thickness is preferably within a range from 0.1$\mu$ to 5 mm.

It is in fact difficult from practical point of view to apply the acidic suspension in a thin layer of 0.1$\mu$ or less. On the other hand, if its thickness exceeds 5 mm, the production speed of colloidal particles such as that of ferric oxyhydroxide would be lowered. Furthermore, precious colloidal particles such as ferric oxyhydroxide so occurred do not stick on the inner surface of the condenser tube and become susceptible of being easily washed away. Consequently, the film-forming speed would be lowered. As the thickness of the acidic suspension increases, a film containing abundant magnetite tends to occur. This film also exhibits excellent corrosion protection properties although its effect is somewhat inferior to a film of iron oxyhydroxide.

As an acidic solution adapted to suspend iron powder therein, any acidic solution can be used as far as it is capable of dissolving (or ionizing) iron powder and causing its smooth oxidation and hydration reaction. An aqueous solution of hydrochloric acid, sulfuric acid, nitric acid or the like may generally be used. Its concentration normally ranges about 0.1 to 2.0 N.

Although there is no specific limitation to the amount of iron powder to be incorporated in the acidic solution, it may usually be added in a proportion of 10 g to 500 g per 100 ml of the acidic solution. A part of the iron powder is dissolved in the acidic solution but the majority of the iron powder is present there in a suspended state. Fine iron powder having a uniform particle size is preferred. The particle size generally ranges from about 0.1 to 200μ.

As a oxidizing gas, oxygen gas or any oxygen-bearing gas may be employed but air is most advantageous from the economical standpoint. For applying the oxidizing gas onto the liquid layer, any suitable conventional method may be adopted, including holding a condenser tube applied with a liquid layer in an oxidizing gas atmosphere or positively blowing an oxidizing gas against the liquid layer. The latter method is preferred. Here, it is preferable to supply the oxidizing gas at a rate of 20 ml/min. to 50 l/min. where the inner surface of a brass tube of one inch in diameter is treated. However, if the oxidizing gas is supplied at a rate lower than 20 ml/min., no significant difference would be observed compared with the former method. The more the supply of the oxidizing gas, the better the results. However, the oxidizing effect reaches a saturated state at 50 l/min. or so. A supply of the oxidizing gas beyond 50 l/min. is wasteful. If the former method is employed, it is recommended to move the gas in the atmosphere by means of a fan or the like. A sufficient film-forming speed can be obtained at normal temperature but the oxidizing gas may be slightly heated to effectively increase the film-forming speed.

Figure 2:
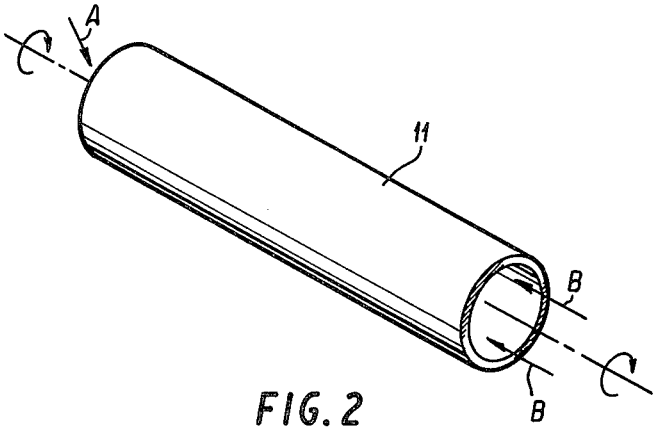
FIG. 2 is a schematic illustration showing an embodiment for applying a layer of an iron powder-containing suspension on a metallic tube.

In order to form a thin liquid layer on the inner surface of a condenser tube and convert it into a film of an iron oxide, various method may be employed, among which the following methods will be given as preferred examples:

(1) A condenser tube is held upright or aslant. A treatment suspension is continually or intermittently caused to flow down from the top of the tube and along the surface to be treated (wall-wetting method). An example of this method is illustrated in FIG. 2, where a condenser tube 11 is disposed aslant, a treatment suspension A is caused to flow down from the top end of the condenser tube 11 to form a liquid layer on its inner surface and, at the same time, an oxidizing gas B is supplied from the lower opening of the tube 11 while rotating the condenser tube 11.

(2) A condenser tube is immersed in a treatment suspension for a while. Then, it is pulled out of the suspension and allowed to stand in an atmosphere of an oxidizing gas for a predetermined period of time. These procedures may be repeated.

Figure 4:
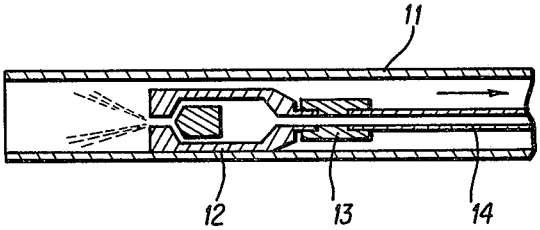
FIG. 4 is a cross-sectional schematic illustration showing a state of spray coating.

(3) As shown in FIG. 4, a treatment suspension is sprayed in the form of mist onto the inner surface of a condenser tube 11 and, thereafter, an oxidizing gas is blown into the tube 11. In other words, the spray coating is rearwardly performed while pulling a supply pipe 14 of an acidic suspension containing iron powder in the direction indicated by the arrow. Numerals 12 and 13 indicate a nozzle and joint respectively.

It is not particularly necessary to subject a condenser tube, to be treated for corrosion protection in accordance with this invention, to any special pre-treatment. However, where the inner surface of a condenser tube is fouled with oil or grease, it is desirable to apply a deoiling or degreasing treatment to the condenser tube in advance since otherwise no uniform liquid layer, in other words, no uniform iron oxide film would be formed.

The outline of the present invention has been described in the above. It can form a uniform corrosion-protective film of high performance on the entire inner surface of a condenser tube made of a copper alloy through a simple operation and in a short time period.

A more complete understanding can be obtained by reference to the following referential example and preferred embodiments of this invention, which are provided herein for the purpose of illustration only and are not intended to limiting unless otherwise specified.

REFERENTIAL EXAMPLE

A suspension containing 500 ml of 0.2 N aqueous hydrochloric acid solution and 50 g of iron powder of 350 mesh was charged into a 1 l-three neck flask equipped with an air-blowing tube and thermometer. An aluminum brass plate (25 mm×40 mm×1 mm) was hung down at a position 20 mm above the surface of the suspension. The suspension was heated to 60° C. and air was blown thereinto through the air-blowing tube at a speed of 1 l/min. Thus, film formation was performed in splash-zone. Five hours later, a reddish brown film (0.8 mg/cm$^2$) was formed. An X-ray diffraction analysis of said film revealed 70% of γ-FeOOH and 30% of α-FeOOH as their components. Treated aluminum brass plate was immersed in sea water for twelve months, developing extremely slight corrosion of the base metal. (Corrosion depth 0.02 mm.)

On the other hand, when the aluminum brass plate was hung down at a position 2 mm above the surface of the suspension, a film principally made of $Fe_3O_4$ was formed.

EXAMPLE 1

An aluminum brass tube (25 mm in diameter and 100 mm in length) was held upright and a suspension similar to that employed in Referential Example was passed intermittently from the top of the tube and downwardly therethrough at a flow rate of 60 ml/min. (equivalent to about 2 mm of liquid layer thickness) for one minute at every 15 minutes. At the same time, air was continuously charged into the tube from the lower end thereof at a flow rate of 5 l/min. This operation lasted 8 hours, forming 2.5 mg/cm$^2$ of a reddish brown film on the entire inner surface of the tube. An X-ray diffraction analysis of the film determined that it consists of 80% γ-FeOOH and 20% α-FeOOH. A sea water passing test (flow rate: 2 m/sec.) was carried out using this tube for 6 months. The corrosion depth of its inner surface was as little as 0.015 mm.

The above procedures were followed except the suspension was continually passed down at a flow rate of 30 ml/min. (equivalent to about 1 mm of liquid layer thickness). A black film with a thickness of 0.4 mg/cm$^2$ was formed in 3 hours. Its components were confirmed to be 90% $Fe_3O_4$ and 10% γ-FeOOH. Similar to the above, a sea water passing test was carried out on the thus-treated tube. The corrosion depth of its inner surface was extremely little, namely, 0.02 mm.

EXAMPLE 2

An aluminum brass tube (25 mm in diameter and 1200 mm in length) was arranged aslant (elevation angle: 5 degree). A suspension similar to that employed in Referential Example was intermittently flowed from the top end thereof and downwardly therethrough at a flow rate of 50 ml/min. (equivalent to about 1–3 mm of liquid layer thickness) for one minute at every 20 minutes while rotating the tube in the circumferential direction thereof at a speed of 1 revolution per minute. On the other hand from the lower end opening thereof, was supplied continually wet air of 100% relative humidity at a flow rate of 2 l/min. This treatment was carried out for 6 hours, forming 10 mg/cm$^2$ of a reddish brown film on the entire inner surface of the tube. As a result of an X-ray diffraction analysis of the film, it was determined that the film consists of 70% of $\gamma$-FeOOH, 20% of $\alpha$-FeOOH and 10% of $Fe_3O_4$. A sea water passing test (flow rate: 2 m/sec) was conducted for 6 months using this tube. The corrosion depth of its inner surface was as little as 0.01 mm.

EXAMPLE 3

An aluminum brass tube (25 mm in diameter and 1200 mm in length) was arranged aslant. While rotating it in its circumferential direction at a speed of 2 revolutions per minute, a suspension consisting of 1000 ml of 0.8 N aqueous hydrochloric acid solution and 200 g of 350 mesh iron powder was caused to intermittently flow down from the top end thereof and downwardly through the tube at a flow rate of 50 ml/min. (equivalent to about 1–3 mm of liquid layer thickness) for one minute at every 15 minutes. After passing the suspension for one minute through the tube a sponge ball was passed therethrough every time. During the test, air was continually charged into the tube from its lower extremity at a flow rate of 4 l/min.

The above operation was conducted for 6 hours, resulting in 1.0 mg/cm$^2$ of a reddish brown film having a smooth surface formed on the entire circumferential inner surface of the tube. As a result of an X-ray diffraction test of the film, it was determined that the film consists of 70% of $\gamma$-FeOOH and 30% of $\alpha$-FeOOH. A sea water passing test was carried out using this tube for 6 months. The corrosion depth of its inner face was 0.03 mm.

By the way, among characteristics required for a corrosion protective film of condenser tubes, there are three important characteristics, i.e., (I) applicability as thin film; (II) uniformity; and (III) adherence to base metal. The thermal conductivity of a tube decreases as the film thickness becomes greater. Thus, a thick film dilutes merits derived from the use of a material having good thermal conductivity, for example, an Al-brass alloy. On the other hand, a non-uniform film thickness produces a turbulent flow along rugged portions thereof. Such a turbulent flow in turn causes a strong shear stress due to a localized high flow velocity, whereby tending to separate the film from the base metal. From these viewpoints, an iron oxide film to be formed in accordance with the above-proposed method involves certain aspects which could still be improved. A further study revealed that, by using as the acidic suspension containing iron powder an iron powder-containing suspension which has been added with a water-miscible organic solvent having a surface tension smaller than water at normal temperature, the surface tension of the acidic suspension can be lowered, thereby making it possible to apply the suspension in the form of a thin, uniform liquid layer. It was also revealed that, by blowing an oxidizing gas in advance into the acidic suspension, the iron powder in the acidic suspension is made finer, thereby improving the uniformity of a resulting film and also the properties of the same.

Iron powder to be employed in the present invention is not accompanied by any special limitation with respect to its production method and particle size. Thus, gas-atomized and water-atomized iron powders may be used extensively. In this invention, the liquid layer can be formed particularly thin. It is accordingly desired to make the particle diameter of iron powder as small as possible. We recommend to use iron powder which pass in its entirety through a shieve of 400 mesh (not greater than about 37 $\mu$m, or preferably iron powder not greater than 10$\mu$ in mean diameter. Among iron powder of a small particle size, there is carbonyl iron powder having a means particle diameter of about 5$\mu$. There is no fear that such iron powder would protrude from an applied liquid layer, providing an extremely advantageous effect to obtain a uniform film thickness.

The acidic solution adapted to suspend therein the above-described iron powder may be selected from those capable of dissolving iron powder and allowing smooth oxidation and hydration reactions thereof to take place. Hydrochloric, sulfuric, or nitric acid may generally be used. Its preferred concentration normally ranges from 0.1 to 2.0 N. Although the amount of iron powder to be incorporated therein is not specifically limited, it is usually preferred to contain about 10–500 g of iron powder per every 100 ml an iron powder-containing acidic solution. A portion of such iron powder is dissolved in the acidic solution, but must of iron powder is contained in a suspended state.

Solvents to be added to the above-described acidic solution for the purpose of lowering the surface tension of the latter should satisfy two conditions, namely, (A) to have a surface tension lower than water at normal temperature and (B) to be water miscible. As far as the above conditions are met, a wide variety of organic solvents may be used. Among representative examples of such organic solvents, are included methanol, ethanol and acetone. They may be used solely or in combination. The amount of such an organic solvent to be incorporated is selected from a range of 5% to 70% by weight based on the total weight of an acidic suspension to be applied. An incorporation of less than 5% by weight of an organic solvent fails to exhibit any sufficient effect to lower the surface tension, whereas a smooth oxidation step of iron powder and $Fe^{++}$ is adversely affected by the presence of an organic solvent in an amount exceeding 70% by weight.

By adding a water-miscible organic solvent as described above, the surface tension of an acidic suspension is lowered and the acidic suspension can thus be applied on the inner surface of a condenser tube in the form of an extremely thin and uniform layer. Thus, where the particle size of the iron powder is great, iron particles may protrude above the surface of the thus-applied layer. In some instances, it is accordingly necessary to subject the film to a surface-smoothening step by a sponge ball or the like. Corollary to this, it is recommended to use in the present invention extremely fine iron powder such as carbonyl iron powder. If somewhat larger iron powder is used, it is suggested to blow an oxidizing gas (i.e., wet air) into the acidic suspension so that the iron powder is subjected to a preparatory oxidation and rendered finer.

After the completion of an application of the acidic suspension on the inner surface of a condenser tube, the thus-applied liquid layer is exposed to an oxidizing gas atmosphere to form a film through the oxidation reaction of the iron powder.

As the oxidizing gas, oxygen or any oxygen-bearing gas may be employed, but air is most advantageous from the economical viewpoint. Air having a high humidity is further meritorious. Such an oxidizing gas may be applied onto the liquid layer by allowing a condenser tube coated with the liquid layer to stand in an atmosphere of an oxidizing gas, or positively blowing an oxidizing gas against the liquid layer. The latter method is preferred. Here, the oxidizing gas may preferably be fed at a rate of 20 ml to 50 l per minute when the inner surface of a brass tube having a diameter of 1 inch is treated. If the former method is followed, it is highly recommended to move the oxidizing gas in the atmosphere by means of a fan or the like. Even at normal temperature, the film-forming speed is high enough. However, the oxidizing gas may be slightly heated to further increase the film-forming speed.

It is not necessary to subject to any pretreatment, all condenser tubes to be treated for corrosion protection in accordance with this invention. However, if the inner surface of a condenser tube is fouled by oil, grease or the like, non-uniform liquid layer tend to be formed. Since this results in the formation of a non-uniform film of an iron oxide, such a fouled condenser tube is preferably subjected to a degreasing treatment.

EXAMPLE 4

The compositions of various acidic suspensions are shown in TABLE 1.

TABLE 1

| Suspension Sample No. | Carbonyl iron Powder (g) | 1.6N—HCl (ml) | Ethanol (ml) | Preparatory Oxidation |
|---|---|---|---|---|
| 1 | 40 | 100 | — | not applied |
| 2 | 80 | 100 | — | " |
| 3 | 50 | 100 | — | " |
| 4 | 100 | 100 | — | " |
| 5 | 100 | 100 | 100 | " |
| 6 | 100 | 100 | 200 | " |
| 7 | 100 | 100 | 800 | " |
| 8 | 100 | 100 | 100 | applied (2.5 hrs.) |
| 9 | 100 | 100 | 100 | applied (1.5 hrs.) |
| 10 | 100 | 100 | 100 | applied (1 hr.) |

Acidic suspensions Nos. 8 to 10 were each prepared by adding 100 g of iron carbonyl powder into 100 ml of 1.6 N-HCl, blowing into the resulting suspension air whose relative humidity was 100% at a rate of 200 ml/min. for the specified time periods, and finally adding 100 ml of ethanol. Acidic suspensions Nos. 8 and 5 (which were not subjected to a preparatory oxidation by wet air) were allowed to stand still for 30 minutes to obtain their respective sedimentation rates of the iron powder [represented by (volume of supernatant/total volume of acidic suspension)×100]. As shown in FIG. 3(*a*), the former suspension indicated by a solid curve) showed a slow sedimentation velocity and the sedimentaion rate after the lapse of 30 minutes was still as low as about 25%, while the sedimentation rate of the latter suspension represented by a dotted line exceeded 60% even 3 minutes after the initiation of the test (stirring the suspension and let it stand still) and reached approximately 70% after the lapse of 30 minutes. This indicates that a preparatory oxidation of the iron powder by blowing an oxidizing gas into an acidic suspension dissolves a part of the iron powder and forms colloidal particles, whereby making the size of the iron particles smaller and stabilizing the suspension.

Next, by using aluminum brass tubes of 22.5 mm in diameter and 300 mm in length as sample tubes, acidic suspensions Nos. 1 to 10 were caused to flow through the sample tubes in accordance with the wall-wetting method as shown in FIG. 1 (intermittently flowed at a flow rate of 60 ml/min., for one minute, every 15 minutes). On the other hand, wet air of 100% relative humidity was supplied at a rate of 5 l/min. from their lower ends. The experiment was stopped 3 hours later. The amount, uniformity and adherence of the ferric oxyhydroxide film formed on each of the sample tubes were measured or observed, providing results summarized in TABLE 2.

TABLE 2

| Suspension Sample No. | Amount ($mg/cm^2$) | Uniformity | Adherence*1 ($Fe^{mg/cm2}$) | Reduction of Overall Coefficient of Heat Transfer (%) | Jet*2 Test ($-mg/cm^2$) | Judgement |
|---|---|---|---|---|---|---|
| 1 | 2.8 | X | 0.7 | 5.8 | 5.1 | X |
| 2 | 4.1 | X | 0.9 | 7.5 | 5.3 | X |
| 3 | 3.5 | Δ | 0.8 | 7.7 | 5.0 | X |
| 4 | 6.1 | X | 1.0 | 10.2 | 7.7 | X |
| 5 | 3.3 | O | 0.3 | 5.8 | 3.2 | O |
| 6 | 1.2 | O | 0.3 | 4.1 | 3.5 | O |
| 7 | 0.6 | O | 0.4 | 3.2 | 3.8 | O |
| 8 | 3.1 | O | 0.1 | 7.2 | 2.1 | O |
| 9 | 3.1 | O | 0.2 | 7.5 | 1.8 | O |
| 10 | 3.0 | O | 0.2 | 7.7 | 2.3 | O |

TABLE 2-continued

| Suspension Sample No. | Amount (mg/cm²) | Uniformity | Adherence*1 Fe^mg/cm2) | Reduction of Overall Coefficient of Heat Transfer (%) | Jet*2 Test (−mg/cm²) | Judgement |
|---|---|---|---|---|---|---|
| Control*3 | 3.5 | O | 0.4 | 7.1 | 3.2 | — |

Note:
*1weight loss of film after a sponge ball of 25 mm in diameter was passed 100 times in tap water.
*2weight loss of the base material (aluminum brass) when sea water was jetted for one month at a flow velocity of 9.0 m/sec. against the coated inner surface of each aluminum brass tube placed 2 mm apart from the outlet of the jet nozzle having an inner diameter of 2 mm.
*3a tube coated with an iron oxide film formed by adding 0.03 ppm $Fe_{++}$ (in the form of $FeSO_4$) to sea water and causing the thus-prepared sea water to flow at a velocity of 2 m/sec. for 3 months while passing a sponge ball (25 mm in diameter) to pass through the tube once every week.
O: good, Δ: fair, X: bad Suspensions Nos. 1 through 4 formed films of insufficient uniformity because they were not added with any organic solvent having low surface tension.

Suspensions Nos. 5 to 10 are particularly preferred embodiments according to this invention, except for Suspension No. 7. Suspension No. 7 contained ethanol in a concentration of about 75%. Thus, in this particular example, the oxidation of iron powder did not take place to a sufficient extent and the resultant film was not sufficiently thick, coupled with a minor problem in adherence too. The remaining suspensions exhibited good results.

EXAMPLE 5

Three iron powder-containing acidic suspensions having compositions shown in TABLE 3 were prepared. Each of the thus-prepared suspensions was separated into four portions. Three of the portions were charged with wet air at a rate of 10 ml/min..cm³. The preparatory oxidation was varied in terms of time period, namely, was carried out for 2.5, 1.5, and 1 hour on the three portions of each suspension respectively.

Then, acidic suspensions Nos. 11 to 13 were caused to flow through aluminum brass tubes of 22.5 mm in diameter and 300 mm in length provided as sample tubes in accordance with the wall-wetting method as shown in FIG. 1 (flowed at a flow rate of 60 ml/min., for one minute, every 15 minutes). On the other hand, wet air of 100% relative humidity was supplied from the lower end of each tube at a flow rate of 10 l/min. The experiment was continued for 3 hours.

TABLE 3

| Suspension Sample No. | Carbonyl iron Powder (g) | 1.6N—HCl (ml) | Blowing Time Period of Wet Air (hr.) |
|---|---|---|---|
| 11-A | 40 | 100 | 0 |
| 11-B | " | " | 1 |
| 11-C | " | " | 1.5 |
| 11-D | " | " | 2.5 |
| 12-A | 50 | " | 0 |
| 12-B | " | " | 1 |
| 12-C | " | " | 1.5 |
| 12-D | " | " | 2.5 |
| 13-A | 80 | " | 0 |
| 13-B | " | " | 1 |
| 13-C | " | " | 1.5 |
| 13-D | " | " | 2.5 |

The amount, uniformity and adherence of the ferric oxyhydroxide film formed on the inner surface of each sample tube are shown in TABLE 4.

TABLE 4

| Suspension Sample No. | Amount (mg/cm²) | Uniformity | Adherence (−mg/cm²) | Reduction of Overall Coefficient of Heat Transfer (%) | Jet Test (−mg/cm²) | Judgement |
|---|---|---|---|---|---|---|
| 11-A | 2.8 | X | 0.7 | 5.8 | 4.8 | X |
| 11-B | 2.9 | Δ | 0.5 | 5.9 | 3.5 | O |
| 11-C | 2.8 | O | 0.3 | 5.7 | 2.8 | O |
| 11-D | 2.8 | O | 0.4 | 5.8 | 2.9 | O |
| 12-A | 3.5 | Δ | 1.0 | 5.5 | 5.0 | X |
| 12-B | 3.6 | Δ | 0.5 | 6.9 | 3.6 | O |
| 12-C | 3.4 | O | 0.4 | 6.8 | 3.1 | O |
| 12-D | 3.5 | O | 0.4 | 7.0 | 3.5 | O |
| 13-A | 4.1 | X | 1.1 | 8.1 | 5.1 | X |
| 13-B | 4.0 | Δ | 0.6 | 8.0 | 4.4 | O |
| 13-C | 4.3 | O | 0.4 | 8.4 | 4.0 | O |
| 13-D | 4.1 | O | 0.5 | 8.3 | 3.7 | O |
| control | 3.5 | O | 0.4 | 7.1 | 3.2 | — |

Note:
O: good, Δ: fair, X: bad

Suspensions Nos. 11-A, 12-A, and 13-A were accompanied by a problem with respect to the uniformity of their resultant films. However, in the groups which were subjected to a preparatory oxidation by blowing wet air into acidic suspensions, excellent uniformity and adhrerence were observed. Suspensions Nos. 11-A, 12-A, and 13-A exhibited a little poor performance during adherence test and jet test due to the poor uniformity of their films, and they are not considered to be suitable for long application.

Suspensions Nos. 12-A and 12-D were selected to determine relationship between the preparatory oxidation and sedimentation rate [represented by (volume of supernatant/total volume of acidic suspension)×100]. Its results are shown in FIG. 3(*b*), in which the sedimentation rates of suspension Nos. 12-A and 12-D are represented by a dotted and solid lines respectively. As appreciated from the diagram, the sedimentation rate exceeded 50% as early as 3 minutes after the initiation of the test and reached near 65% after the lapse of 30 minutes where no preparatory oxidation was applied. On the other hand, where a preparatory oxidation was applied, a part of the iron powder was oxidized and thus dissolved in the suspension as colloidal particles and the iron powder was made smaller, thereby having increased the stability of the suspension. The sedimentation rate of suspension No. 12-D was only about 20% even after the lapse of 30 minutes.

A single application of a spray coating of an iron powder-containing acidic suspension is sufficient if, as shown in FIG. 4, the suspension is sprayed onto the inner surface of a condenser tube while pulling a supply pipe 4 in a direction indicated by the arrow. A subsequent supply of an oxidizing gas into the condenser tube forms a corrosion protective film by the oxidation of the iron powder.

Here, it is desirous to use iron powder having a mean particle diameter of 10μ or less as described in the above. Iron powder which has a mean particle diameter of about 5μ and is known in the name of carbonyl iron powder is especially preferred. The content of iron powder in an acidic suspension is suitably in the order of 10 to 500 g/100 ml. A content lower than 10 g/100 ml is too low to provide a film of a desired thickness by a single spray-coating thereof. On the other hand, a content exceeding 500 g/100 ml renders the spray-coating per se difficult.

It is recommended to blow into an acidic suspension an oxidizing gas at a flow rate of 1~50 ml/min. $cm^3$. As a blowing time period, 0.5 to 4 hours are recommended.

Effects of other embodiments of this invention will be described below by reference to the following examples and comparative examples.

EXAMPLE 6

Iron powder-containing acidic suspensions having compositions shown in TABLE 5 were prepared.

TABLE 5

| Sample No. | Carbonyl iron Powder (kg) | Dilute Hydrochloric acid (l) | Ethanol (l) | Preparatory Oxidation and Time (hr.) |
|---|---|---|---|---|
| 21 | 10 | 1.6N-10 | — | not applied |
| 22 | 10 | 1.6N-10 | 10 | " |
| 23 | 10 | 0.8N-20 | — | " |
| 24 | 10 | 0.8N-20 | 20 | " |

TABLE 5-continued

| Sample No. | Carbonyl iron Powder (kg) | Dilute Hydrochloric acid (l) | Ethanol (l) | Preparatory Oxidation and Time (hr.) |
|---|---|---|---|---|
| 25 | 10 | 1.6N-10 | 10 | applied (2.5 hrs.) |
| 26 | 10 | 1.6N-10 | 10 | applied (1 hr.) |
| 27 | 10 | 1.6N-10 | — | applied (2.5 hrs.) |
| 28 | 10 | 1.6N-10 | — | applied (1 hr.) |

The preparatory oxidation in TABLE 5 was conducted by blowing wet air at a rate of 10 ml/min.·$cm^3$. Next, the inner surfaces of aluminum brass tubes of 22.5 mm in diameter and 2 m in length were coated with the above suspensions in accordance with the air-less spray method in which the supply pressure of each suspension and the moving speed of the nozzle were set 62.5–70 kg/$cm^2$ and 1–2 m/sec. respectively. Against the thus-coated inner surface, was supplied wet air at a flow rate of 2 l/min. for 2.5 hours. The amount, uniformity and adherence of the iron oxyhydroxide film formed on the inner surface of each condenser tube are summarized in TABLE 6.

TABLE 6

| Sample No. | Amount (mg/$cm^2$) | Uniformity | Adherence (−mg/$cm^2$) | Reduction of overall coefficient of heat transfer (%) | Jet Test (−mg/$cm^2$) | Judgement |
|---|---|---|---|---|---|---|
| 21 | 5.2 | O | 0.3 | 9.1 | 2.8 | O |
| 22 | 2.6 | O | 0.2 | 5.5 | 2.2 | O |
| 23 | 2.7 | O | 0.3 | 6.1 | 2.5 | O |
| 24 | 1.3 | O | 0.3 | 4.2 | 2.7 | O |
| 25 | 2.4 | O | 0.2 | 5.0 | 2.1 | O |
| 26 | 2.5 | O | 0.3 | 4.5 | 2.5 | O |
| 27 | 5.5 | O | 0.3 | 8.2 | 2.3 | O |
| 28 | 4.9 | O | 0.3 | 8.9 | 2.1 | O |
| control | 3.4 | O | 0.4 | 7.3 | 2.9 | — |

Note:
O: good

Each of the above experiments met the objects of this invention and yielded in a short time period a thin film having good adherence and uniformity. In order to determine whether there are any differences between a suspension (A) which had been subjected to a preparatory oxidation and another suspension (B) which had not been subjected to a preparatory oxidation, a comparison was made with respect to the stability, namely, sedimentation ratio of iron powder in each of the suspensions. Its results are shown in FIG. 3(*c*), in which the sedimentation rates of suspensions (A) and (B) are illustrated by solid and dotted lines respectively. Where no preparatory oxidation was applied, a sedimentation rate over 60% was observed as early as 3 minutes after the initiation of the test and the sedimentation rate reached near 70% after the lapse of 30 minutes. Contrary to the suspension (B), the sedimentation velocity of the suspension (A) was slow and the sedimentation rate remained as little as 25% or so even after the lapse of 30 minutes.

Having now fully described the present invention, it will be apparent to one of ordinary skill in the art that many changes and modifications can be made thereto without departing from the spirit or scope of the invention as set forth herein.

What is claimed is:

1. A method for protecting the inner surface of a copper alloy condenser tube from corrosion, said method comprises applying a thin layer of an acidic suspension containing iron powder onto the inner surface of the copper alloy condenser tube, and exposing said thin layer to an atmosphere of an oxidizing gas to form a film of an iron oxide on said inner surface.

2. The method according to claim 1, wherein said suspension is made from an acid or acids selected from the group consisting of aqueous hydrochloric, sulfuric and nitric acid, and iron powder.

3. The method according to claim 2, wherein the concentration of said acid ranges from 0.1 to 2.0 N.

4. The method according to claim 1 or 2, wherein the acidic suspension further comprises a water-miscible organic solvent having a surface tension smaller than water at normal temperature.

5. The method according to claim 4, wherein the organic solvent is at least one solvent selected from the group consisting of methanol, ethanol and acetone.

6. The method according to claim 5, wherein said organic solvent is contained in an amount of 5 to 70% by weight of said acidic suspension.

7. The method according to claim 6, wherein the particles of said iron powder are smaller than 400 mesh.

8. The method according to claim 7, wherein the particle size of the iron powder is between 0.1 μm and 37 μm.

9. The method according to claim 8, wherein the iron powder is carbonyl iron powder.

10. The method according to claim 9, wherein 10 g to 500 g of the iron powder is contained in every 100 ml of the suspension.

11. The method according to claim 4, wherein said acidic suspension is subjected to an oxidizing treatment by blowing an oxidizing gas thereinto prior to its application onto the inner surface of the copper alloy condenser tube.

12. The method according to claim 11, wherein said oxidizing gas is wet air.

13. The method according to claim 4, wherein the thin layer of the acidic suspension is made smoother by passing a sponge ball through the tube.

14. The method according to claim 1, wherein said thin layer has a thickness of 0.1 μm to 5 mm.

15. The method according to claim 1, wherein wet air is blown as said oxidizing gas against said layer.

16. The method according to claim 1, wherein said acidic suspension contains 10 g to 500 g/100 ml of iron powder having an average particle diameter not greater than 10 μm and said acidic suspension is sprayed onto said inner surface of the condenser tube.

17. The method according to claim 16, wherein said acidic suspension is sprayed in accordance with the airless spray coating method.

* * * * *

UNITED STATES PATENT AND TRADEMARK OFFICE

CERTIFICATE OF CORRECTION

PATENT NO. : 4,369,073

DATED : January 18, 1983

INVENTOR(S) : Toshio Fukutsuka et al

It is certified that error appears in the above—identified patent and that said Letters Patent is hereby corrected as shown below:

Column 2, line 57, "0.1μ" should read --0.1μm--;

Column 2, line 59, "0.1μ" should read --0.1μm--;

Column 6, line 19, "shieve" should read --sieve--;

column 6, line 38, "must" should read --most--;

Column 8, line 23, "indicated by a solid curve)" should read --(indicated by a solid curve)--;

Column 8, line 25, "sedimentaion" should read --sedimentation--;

Column 8, Table 2, "$Fe^{mg/cm2}$" should read -- -mg/cm2 --;

Column 9, Table 2, "$Fe^{mg/cm2}$" should read -- -mg/cm2 --;

Column 10, line 59, "adhrerence" should read --adherence--.

Signed and Sealed this

*Seventh* Day of *June 1983*

[SEAL]

*Attest:*

DONALD J. QUIGG

*Attesting Officer*

*Acting Commissioner of Patents and Trademarks*